US005335605A

United States Patent [19]

Drabczyk

[11] Patent Number: 5,335,605

[45] Date of Patent: Aug. 9, 1994

[54] DECORATIVE PANEL CONSTRUCTION FOR OFFICE FURNITURE

[75] Inventor: Matthew P. Drabczyk, Westminster, Colo.

[73] Assignee: Engineered Data Products, Inc., Broomfield, Colo.

[21] Appl. No.: 752,779

[22] Filed: Aug. 30, 1991

[51] Int. Cl.[5] ..... A47B 3/06

[52] U.S. Cl. ..... 100/153; 312/265.6; 312/204

[58] Field of Search ..... 108/153, 111; 52/221, 52/220, 239; 312/265.5, 265.6, 204

[56] References Cited

U.S. PATENT DOCUMENTS

| | | | |
|---|---|---|---|
| 3,105,726 | 10/1963 | Jung | 312/265.6 X |
| 3,408,127 | 10/1968 | Vincons | 312/204 X |
| 3,697,363 | 10/1972 | Martinez | 312/204 X |
| 3,857,622 | 12/1974 | Mohr et al. | 312/265.6 |
| 4,066,305 | 1/1978 | Gazarek | 312/265.6 X |
| 4,288,132 | 9/1981 | Znamironski et al. | 312/265.5 |
| 4,918,886 | 4/1990 | Benoit et al. | 52/221 |
| 5,062,246 | 11/1991 | Sykes | 52/221 X |
| 5,130,494 | 7/1992 | Simonton et al. | 108/50 X |

*Primary Examiner*—Jose V. Chen
*Attorney, Agent, or Firm*—Glenn L. Webb

[57] ABSTRACT

Support members for office furniture. The present disclosure provides structural panels having smooth interior surfaces and support ribs affixed to their exterior surfaces. A decorative panel having a smooth exterior surfaces is mounted over the structural panel to cover the support ribs and provide a smooth exterior surface to the support members. In one embodiment, the decorative panels slide over the structural panel. In a second embodiment, the decorative panels engage the upper surface of the structural panels and pivot downward over the structural panels. The decorative panels are easily replaceable and can be painted in a variety of colors and patterns. Wood grain steel vinyl laminate can also be applied to the decorative panels.

19 Claims, 3 Drawing Sheets

DECORATIVE PANEL CONSTRUCTION FOR OFFICE FURNITURE

BACKGROUND OF THE INVENTION

1. Field of the invention

This invention relates to the field of office furniture construction, particularly to vertical support panels for office furniture.

2. Statement of the Problem

Typical office furniture construction is of three types: solid wood, particle board construction, and metal frame construction. Solid wood construction furniture is very expensive and is quite heavy. Also, this type of furniture is very difficult to move, due to size and weight considerations. Damage to this type of furniture is also difficult to repair.

Particle board construction, although less expensive and easier to assemble, is easily damaged. This type of furniture must meet high standards for burn resistance, particularly in government offices.

Metal frame construction furniture is widely used in large offices and in government offices. Typically, in metal frame construction furniture, the vertical support members, such as the sides and fronts, are formed from sheet metal with support ribs affixed to the sheet metal to stiffen the members. Without these support ribs, the furniture is flimsy. These support ribs can either be affixed to the exterior of the furniture, but are more typically affixed to the interior of the furniture. Even though the support ribs may be affixed to the interior of the furniture, the ribs are still visible on the furniture. The prior art metal construction furniture typically had visible imperfections due to welding, bonding, riveting, etc. Fasteners were also normally visible in the prior art furniture. Also, this type of furniture is typically available in a limited choice of color and designs, normally grey or black.

All of these types of office furniture construction are normally available in limited colors and designs. It is usually impossible to change color and design schemes without replacing the furniture. Damage to the prior art furniture is also difficult to repair without leaving visible marks.

Therefore, a need exists for attractive durable office furniture construction that is easy to ship, assembly and alter.

3. Solution to the Problem

The present invention provides furniture construction that is attractive as well as highly durable.

The present invention provides furniture construction that has clean, attractive lines without visible support members.

The present invention provides furniture that can be designed in a various colors and patterns.

The present invention provides furniture that is easily altered according to different color needs.

The present invention provides furniture that is easily repairable.

The present invention provides furniture that can be shipped flat and assembled on site.

These and other features will be evident from the ensuing description of the invention taken in conjunction with the drawings.

SUMMARY OF THE INVENTION

The present invention provides furniture construction, particularly for office and computer furniture, solving these and other problems. The construction of furniture of the present invention includes support members having a structural panel and a decorative panel. The structural panels have a smooth surface with support ribs affixed to the opposing wall of the structural panels for rigidity and strength. Decorative panels having smooth clean lines are mounted to the structural panels to cover the support ribs.

The decorative panels include a smooth exterior wall having corners formed in a desired design shape, such as faceted, beveled, round or square. The side edges of the decorative panel of the side support members are bent inward to be substantially parallel to the wall portion of the decorative panel and spaced from the wall portion approximately the width of the structural panels. Since there are no stiffening ribs attached to the decorative panel, the steel is clean and free from imperfections caused by welding, adhesives, rivets and the like.

The side edges of the side support member structural panels are offset inward slightly to slidably receive the inwardly bent side edges of the decorative panel. The side support members also include hooks extending downward from the upper edge of the structural panel which mate with notches formed in the upper edge of the decorative panel.

The decorative panels are mounted on the structural panel by sliding over the structural panels so that the side edges of the decorative panel engage the interior of the side edges of the structural panel. The hooks of the upper edge of the structural panel engage in slots formed on the upper edge of the decorative panels. The decorative panels of the side support members thus cover the support ribs affixed on the structural panels. Cables, from computers, business machines, lights and the like are also able to be routed through the structural panels and hidden by the decorative panels. Fasteners are also hidden by the decorative panels.

The structural panel of the rear panels include at least one horizontally extending support rib affixed to the exterior side of the structural panel. The upper edge of the structural panel includes at least one slot. The side edges of the structural panel extend perpendicularly from the structural panels. Mounting holes are formed in these side edges for fastening to the side support member structural panels. The decorative panel includes at least one hook on the upper edge for engagement in the slot of the upper edge of the decorative panel. The corners of the decorative panel are designed to fit flush against the side edges of the structural panel. The hooks of the decorative panel are inserted in the slots of the structural panel. The weight of the decorative panel forces the decorative panel to pivot downward so the corner edges of the decorative panel fit flush against the side edges of the structural panel to cover the support ribs of the structural panel. If necessary, attachment screws can be used to secure the lower edges of the decorative panel and structural panel together.

The decorative panels can be painted as desired or a wood grain steel vinyl laminate can be applied to simulate wood furniture. Since there is no welding or heat applied to the decorative panels, it is possible to apply laminate directly on the panels. The use of the decorative panels and structural panels afford flexibility in office decor. The components can be shipped separately flat to reduce transporting costs as well as reducing the assembly and inventory costs. Furniture repair can be easily done by simply changing decorative panels. Office decor can also be easily altered by changing the decorative panels as desired.

These and other features will be evident from the ensuing description of a detailed description of a possible preferred embodiment taken in conjunction with the drawings.

DETAILED DESCRIPTION OF A PREFERRED EMBODIMENT

The present invention provides side and rear support members for furniture, particularly for office and computer furniture. As discussed in the background of the invention, the prior art furniture typically was constructed of solid wood, which was expensive, heavy, and difficult to move, particle board, which is easily damaged and must meet, in some applications, critical standards, or metal frame construction furniture. Metal frame construction furniture typically uses support members formed of sheet metal with interior or exterior support ribs which are visible and mar the lines of the furniture. Also, metal frame construction furniture may have visible fasteners and imperfections from welding or riveting which also affect the appearance of the furniture. The present invention provides support members which have clean, attractive lines, which can be transported flat for on-site assembly, and which can be matched to the design of the office in which the furniture is being used.

Figure 1:
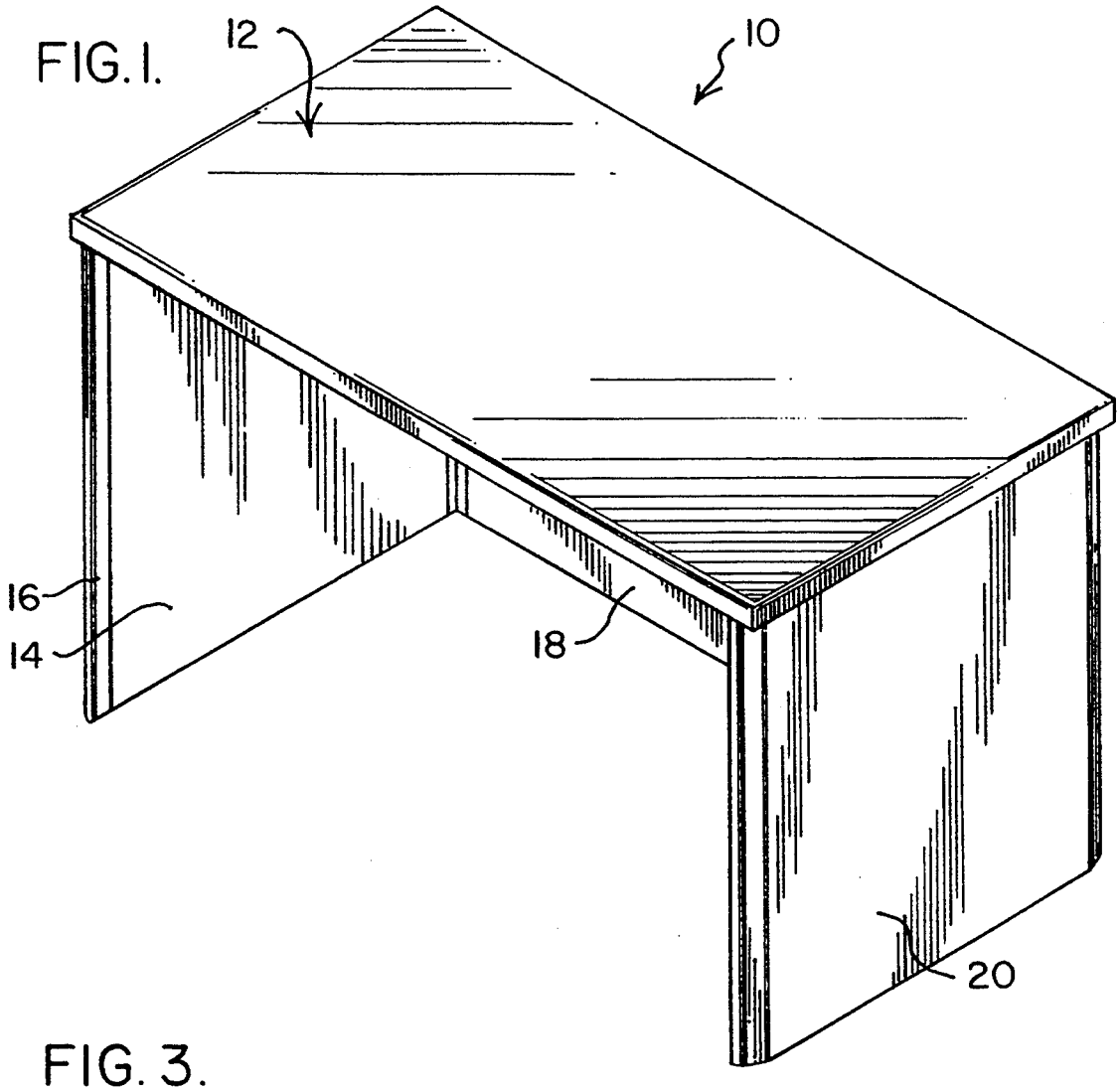
FIG. 1 is a perspective view of a desk utilizing the decorative panels of the present invention.

One possible preferred embodiment of the present invention is illustrated in FIGS. 1–5, utilized in an office desk. Desk 10, as shown in FIG. 1, includes desk top 12, left side support member 14, rear support member 18 and right side support member 20. In this embodiment, desk 20 includes side support members having a faceted design on the corner free edges which wraps around the corner, such as at corner 16 of side support member 14. This allows the desk to have a distinctive ornamental design. The ornamental free edge could also be used on other free edges of the furniture, such as the desk top 12. It is to be expressly understood that this descriptive embodiment is for explanatory purposes only and is not meant to limit the scope of the inventive concept. Other embodiments and configurations of the support members and of the uses of the support members are considered to be within the scope of the claimed invention. For instance, the support members of the claimed invention may be utilized in tables, bookcases, desks, credenzas, organizers, and the like. Also, the support panels can be of other configurations and design shapes other than as illustrated and described in the present exemplary embodiment.

Figure 3:
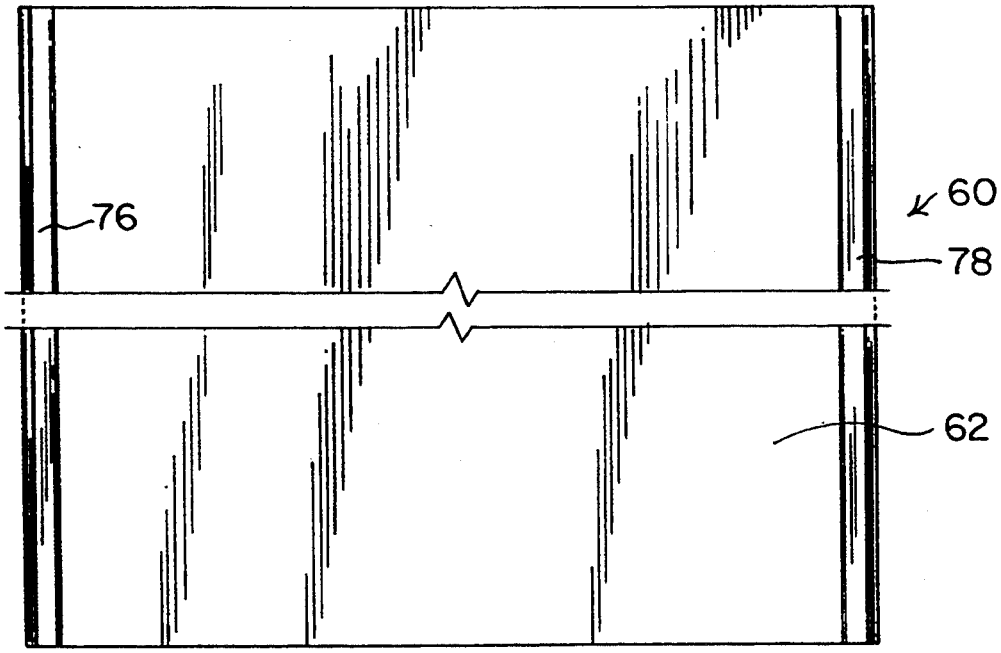
FIG. 3 is a interior side view of the panel of FIG. 2.
Figure 2:
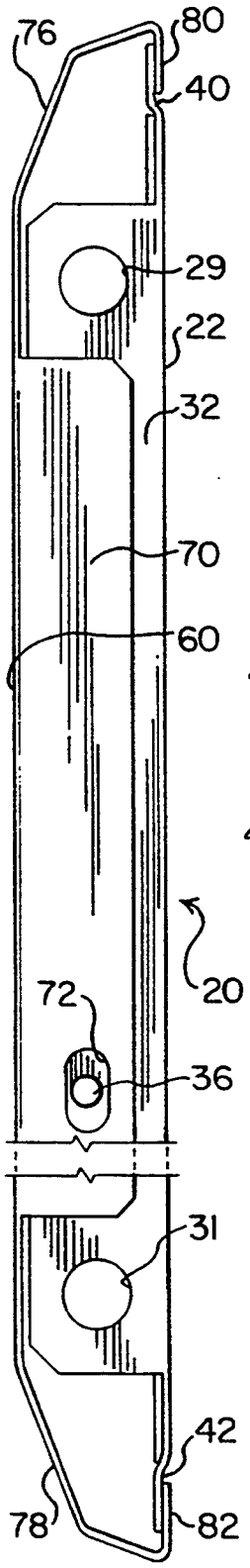
FIG. 2 is a top view of a possible preferred embodiment panel of the present invention.

Side support members 14 and 20 are similar in configuration, therefore only side support member 20 will be described in detail. Side support member 20, as shown in FIGS. 2–4, includes structural support panel 22 and decorative panel 60.

Figure 4:
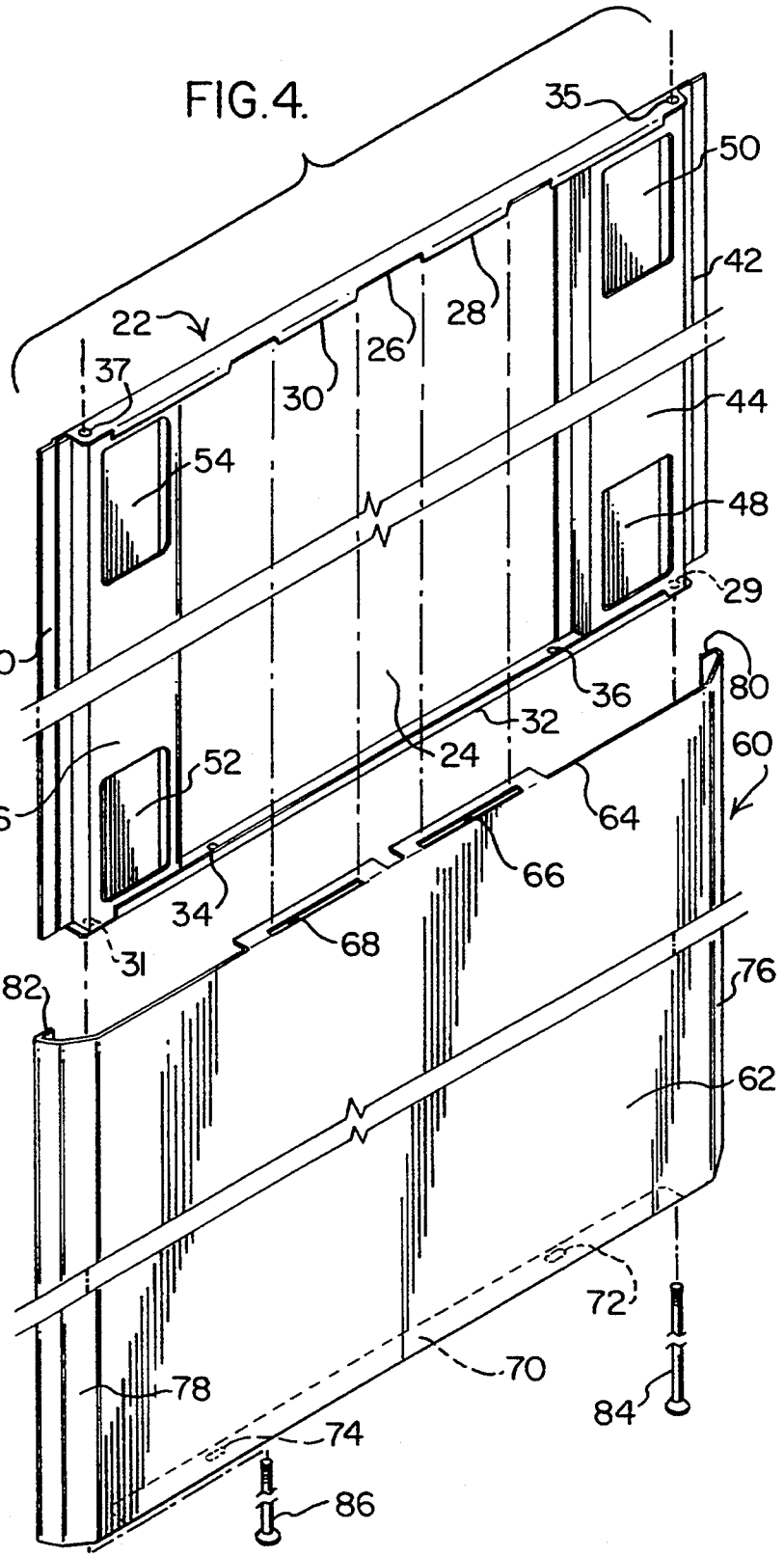
FIG. 4 is an exploded view of the sections of the panel of FIG. 2.

Structural support panel 22 includes interior wall portion 24, shown in FIG. 4. Wall portion 24 includes upper edge portion 26 formed on the upper end of structural panel 22 with hook portions 28, 30 extending downward from upper edge portion 26. Holes 35, 37 are also formed in upper edge portion 26 for insertion of leveling guides, as discussed below. Lower edge portion 32 is formed on the lower end of interior wall portion 24 of structural panel 22 having mounting holes 34, 36 for attachment to decorative panel 60 and to desk top 12. Holes 29, 31 are also formed in lower edge portion 32 for insertion of leveling guides, as discussed below. Side edge 40 on interior wall portion 24 of structural panel 22 is offset slightly while extending parallel to the plane of interior wall portion 24. Likewise, opposing side edge 42 is also offset slightly extending parallel to the plane of interior wall portion 24. The function of side edges 40, 42 is discussed below.

Support ribs 44, 46 are affixed to interior wall portion 24 by spot welding or other conventional techniques. Support ribs 44, 46 are spaced as necessary to provide rigidity to structural support panel 22. Additional support ribs can be added, if necessary to provide additional rigidity and strength to the support members. Support ribs 44, 46 of the present embodiment are formed of structural sheet metal in an inverted "U"-shape. However, other types and shapes of support ribs are considered to be within the claimed inventive concept. Leveling guide 84 is inserted through holes 29, 35 of panel 22. The upper end of leveling guide 84 is fastened into desk top 12 to secure side support members therethrough. Leveling guide 86 is similarly inserted through holes 31, 37. After the desk has been assembled, the leveling guides can be adjusted to level the desk.

Recesses 48, 50 are formed in support rib 44 and recesses 52, 54 are formed in support rib 46 to allow "knock-out"s in structural panel 22 for routing of cables of business machines, computers, lights and the like. The recesses can also be used to allow access to mounting bolts to the desk stop and for mounting of desk drawers, credenzas and the like if desired. Typically, in prior art construction, nuts or bolts were welded in place, since there was no access to them. In the present invention, nut and bolts can be used and still be hidden by the decorative panel. Also mounting is possible using the "knock-outs" and conventional fasteners, i.e. nuts and bolts, which are hidden by the decorative panel. This allows flexibility as well as uniform construction in the construction of the furniture. The need to inventory various configurations of the support members is thus reduced. Recesses 48, 50, 52, 54 also provide weight savings in the support members.

Decorative panel 60 includes exterior wall portion 62. Exterior wall portion 62 includes upper edge portion 64 at its upper end having slots, 66, 68 for engagement with hooks 28, 30 of upper end portion 26 of structural panel 22. Exterior wall portion 62 also includes lower edge portion 70 having mounting holes 72, 74 matching the location of mounting holes 34, 36 of structural panel 22.

Corner portions 76, 78 are formed on decorative panel 60, as shown in FIGS. 2–4. Corner portions 76, 78 are bent at an angle to the body of exterior wall portion 62. Corner portions 76, 78 are illustrated in FIGS. 2–4 with a faceted corner, but other styles and designs of corners are considered within the claimed invention.

For instance, round, beveled or square corners are all contemplated within the claimed invention.

Edge portions 80, 82 are formed on corner portions 76, 78, respectively, extending substantially parallel to exterior wall portion 62 and spaced from exterior wall portion 62 by approximately the width of structural panel 22. Edge portions 80, 82 engage side edges 40, 42 on the interior of structural panel 22 when decorative panel 60 is mounted onto structural panel 22, as shown in FIG. 2. Decorative panel 60 is mounted onto structural panel 22 by aligning edge portions 80, 82 with side edges 40, 42 and then sliding decorative panel 60 over upper edge portion 32 as shown in FIG. 4 until hooks 28, 30 are fully engaged in slots 66, 68.

Edge portions 80, 82 lie substantially in the same plane as the interior wall of structural panel 22 as shown in FIG. 2. This provides a smooth, "clean" line, not only on the exterior of the support member but also on the interior of the support member. Edge portions 80, 82 can be painted or laminated to be the same color or pattern as the interior of the furniture or else a differing color or pattern as desired.

Figure 5:
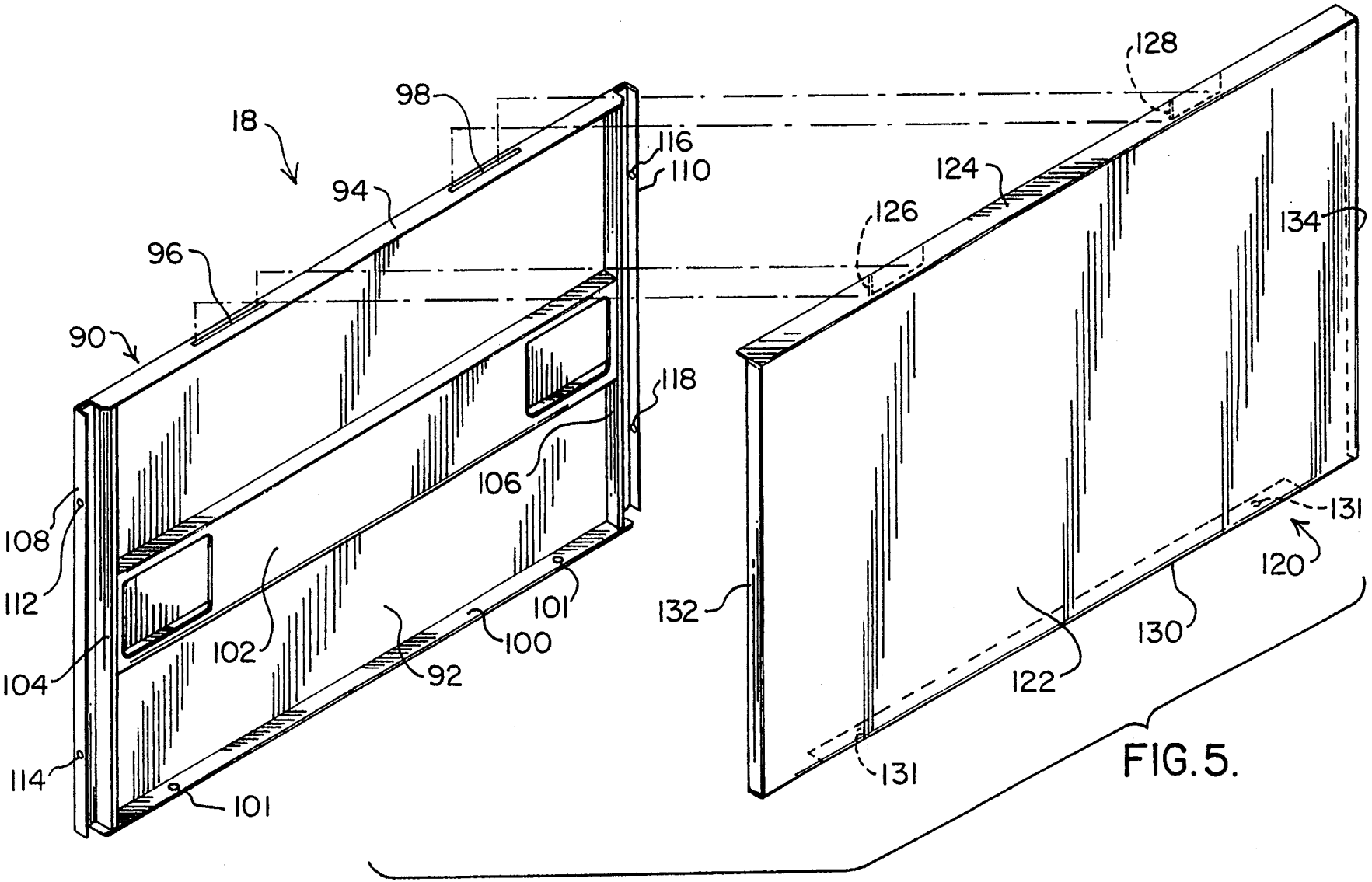
FIG. 5 is an exploded view of the sections of a front panel of one possible preferred embodiment of the present invention.

Rear support member 18, illustrated in FIG. 5, is substantially similar to side support members 14, 20 with some changes due to the length and weight of rear support member 18. Rear support member includes structural panel 90 and decorative panel 120. Structural panel includes wall portion 92 with upper edge 94 extending substantially the length of wall portion 92 having slots 96, 98 formed therein. Lower edge 100 extends perpendicularly from wall portion 92.

Support rib 102 is affixed to wall portion 92 extending substantially the length of wall portion 92 between side support ribs to provide rigidity to support member 18. A plurality of support ribs extending in various directions can be used if desired. Recesses are provided in support rib 102 for weight savings. Vertical support ribs 104, 106 are affixed to structural panel 90 near the side edges of the structural panel to provide additional rigidity and support to rear panel 18. Side edge portions 108, 110 extend outward from wall portion 92 perpendicular from wall portion 92. Holes 112, 114 in side edge 108 and holes 116, 118 in side edge 110 are provided for fastening to the structural panels of side members 14, 20. Fasteners can be inserted through the "knock-outs" of the structural panels of the side support members and through holes 112–118. The decorative panels of both the rear support member and side support members cover these fasteners so they are not visible.

Decorative panel 120 includes exterior wall portion 122 having upper edge portion 124. Upper edge portion 124 includes hook portions 126, 128 extending downward and spaced to mate with slots 96, 98 on upper edge 94 of structural panel 90. Lower edge 130 extends perpendicularly from wall portion 122 substantially the full length of wall portion 122. Corner edges 132, 134 extend substantially perpendicular from wall portion 92 approximately the width of structural panel 90.

Decorative panel 120 is mounted onto structural panel 90 by inserting hook portions 126, 128 into slots 96, 98 on upper edge portion 94 of structural panel 90. The weight of decorative panel 120 will cause decorative panel 120 to pivot downward until lower edge portion 130 is engaged under lower edge portion 100 of structural panel 90. Attachment screws (not shown) can be used, if necessary, to on lower edge portions 100, 130 to secure decorative panel 120 to structural panel 90.

It is to be expressly understood that the above descriptions of possible embodiments of the present invention are for explanatory purposes only and are not meant to limit the claimed invention. Other embodiments and configurations are contemplated within the claimed invention. For instance, other devices for attaching the decorative panels to the structural panels may include screw attachments, welding, bonding as well as other attachment techniques. Also, the design of the structural panels and/or the decorative panels can include a variety of shapes and configurations.

The present invention provides support members for office furniture not limited to tables or desks, but includes other types of furniture, such as credenzas, desk organizers, bookcases and the like. Also, the furniture construction is not meant to be limited to office furniture but includes other styles of furniture, including computer furniture and home furniture for which the present invention may have application. The present invention includes support members having an interior structural panel, support ribs affixed to the exterior of the structural panel, and decorative panel mounted over the exterior of the structural pane. The present invention also includes an exterior structural panel, support ribs affixed to the interior of the structural panel, and decorative panels affixed over the interior of the structural panel.

I claim:

1. A support member for office furniture, said support member comprising:

a structural panel member for supporting a horizontally extending surface;

an external finished surface on said structural panel member;

an inner surface on said structural panel member on the opposite side of said external surface;

side edges on said external finished surface on said structural panel member;

a decorative panel having an external finished surface, an internal surface, and side edge surfaces on said internal surface, said internal side edge surfaces engaging said side edges on said external finished surface on said structural panel member to enclose said side edges and said inner surface to form corner edges of office furniture.

2. The support member of claim 1 wherein said structural member includes:

means affixed to said inner surface for structurally reinforcing of said structural panel member; and said decorative panel covers said inner surface and said reinforcing means.

3. The support member of claim 1 wherein said decorative panel includes:

a substantially flat exterior portion; and said side edge surfaces engage said external finished surface by sliding over said structural panel member.

4. The support member of claim 1 wherein said decorative panel includes:

a substantially flat exterior portion; and means on said decorative panel for engaging an upper surface of said structural panel member to allow said decorative panel to pivot downward over said inner surface of said structural panel member.

5. The support member of claim 1 wherein said decorative panel include:

an exterior surface adapted to be painted in one of a variety of colors as desired.

6. The support member of claim 1 wherein said decorative panel include:

a laminated vinyl exterior surface to simulate wood grain.

7. The support member of claim 1 wherein said decorative panel include:

means for interchanging said decorative panel means with other decorative panel means.

8. An article of furniture, said article of furniture comprising:

at least one structural panel for supporting a horizontal surface;

an external finished surface on said structural panel;

an inner surface on said structural panel on the opposite side of said external surface;

side edges on said external surface on said structural panel;

means affixed to said inner surface on said at least one structural panel for reinforcing said at least one structural panel; and a decorative panel having side edge surfaces engaging said side edges on said external surface to removably affix said decorative panel to said at least one structural panel covering said inner surface and said side edges to form a corner edge of said article of furniture.

9. The article of furniture of claim 8 wherein said decorative panel includes means for pivotal engagement between the upper end of said decorative panel means and the upper end of said at least one structural panel.

10. An article of furniture, said article of furniture comprising:

a horizontal surface;

a first support member supporting said horizontal surface; said first support member including:

a first structural panel supporting said horizontal surface;

an exterior finished surface on said first structural panel;

an inner surface on said first structural panel opposite said exterior finished surface;

side edges on said exterior finished surface on said first structural panel;

a first decorative panel having side edge surfaces engaging said side edges on said exterior finished surface on said first structural panel enclosing said inner surface and said side edges to form a corner edge of said article of furniture; and a second support member supporting said horizontal surface and mounted on said article of furniture substantially perpendicular to said first support member, said second support member includes:

a second structural panel supporting said horizontal surface;

an exterior finished surface on said second structural panel;

an inner surface on said second structural panel opposite said exterior finished surface;

side edges on said second structural panel;

a second decorative panel having side edge surfaces engaging said side edges on said second structural panel enclosing said inner surface and said side edges no said second structural panel to form a corner edge of said article of furniture.

11. The article of furniture of claim 10 wherein said first decorative panel engage portions of said finished exterior surface of said first structural panel.

12. The article of furniture of claim 10 wherein said second decorative panel pivotally engages the upper end of said second structural panel.

13. A method of forming an article of furniture, said method comprising the steps of: providing a horizontal surface providing at least one support member having an exterior finished surface, an inner surface opposite said exterior finished surface and side edges on said exterior finished surface supporting said horizontal surface;

providing a decorative panel having an external finished surface and an internal surface for each of said at least one support members or enclosing said inner surface and said side edges forming a corner edge of said furniture; and mounting said decorative panels on each of said at least one support members so said internal surface engages said side edges on said exterior finished surface of said support members.

14. The method of claim 13 wherein said step of mounting said decorative panels on each of said at least one support members includes the steps of:

sliding each of said decorative panels over the sides of each of said at least one support member opposite said inner surface.

15. The method of claim 13 wherein said step of mounting each of said decorative panels on each of said at least one support members includes the steps of:

pivotally engaging each of said decorative panels with the upper end of each of said a least one support members.

16. The method of claim 13 wherein said step of providing a decorative panel further includes the step of:

selecting a decorative panel of a desired color.

17. The method of claim 13 wherein said step of providing a decorative panel further includes the step of:

selecting a decorative panel of a simulated wood grain steel vinyl.

18. The method of claim 13 wherein sid method further comprises the steps of:

removing a damaged decorative panel from said at least one support member;

providing a replacement decorative panel; and mounting said replacement decorative panel on said at least one support member.

19. The method of claim 13 wherein said method further comprises the steps of:

changing the color or design of said article of furniture by removing said decorative panel from said at least one support member;

selecting a replacement decorative panel of a different color or design; and mounting said replacement decorative panel on said at least one support member.

* * * * *